United States Patent [19]

Blohm et al.

[11] 4,275,553

[45] Jun. 30, 1981

[54] PROCESS AND APPARATUS FOR SERVICING A NUMBER OF MUTUALLY ADJACENT SPINNING POSITIONS OF AN OPEN-END SPINNING MACHINE

[75] Inventors: Reinhard Blohm, Buchholz; Rupert Karl, Ingolstadt; Hans Sarcander, Kosching, all of Fed. Rep. of Germany

[73] Assignee: Schubert & Salzer, Ingolstadt, Fed. Rep. of Germany

[21] Appl. No.: 15,899

[22] Filed: May 17, 1979

[30] Foreign Application Priority Data

Mar. 3, 1978 [DE] Fed. Rep. of Germany ..... 2809001

[51] Int. Cl.[3] ..... D01H 15/00; D01H 15/02

[52] U.S. Cl. ..... 57/263; 57/261

[58] Field of Search ..... 57/1 R, 99, 261, 263, 57/264, 268, 270, 271, 276; 242/36, 43 R, 57

[56] References Cited

U.S. PATENT DOCUMENTS

| | | | |
|---|---|---|---|
| 3,503,198 | 3/1970 | Goldammer et al. | 57/271 |
| 3,902,308 | 9/1975 | Bernstein et al. | 57/264 X |
| 3,950,926 | 4/1976 | Stahlecker | 57/263 |
| 4,028,869 | 6/1977 | Shafer et al. | 57/264 |
| 4,047,371 | 9/1977 | Stahlecker et al. | 57/263 |
| 4,178,748 | 12/1979 | Stahlecker et al. | 57/268 X |

*Primary Examiner*—Donald Watkins

*Attorney, Agent, or Firm*—Bailey, Dority & Flint

[57] ABSTRACT

A method and apparatus for servicing a number of mutually adjacent spinning positions of an open-end spinning machine by means of a servicing apparatus which can move along the spinning positions. A travel drive is provided for the servicing apparatus for driving the servicing apparatus along the spinning machine when activated. Switches are connected to the travel drive for activating the travel drive responsive to being activated by an operator at a spinning station requiring service. A switch is also provided for de-activating the travel drive for halting the movement of the service apparatus in the neighborhood of the operator at the spinning station requiring service.

20 Claims, 6 Drawing Figures

PROCESS AND APPARATUS FOR SERVICING A NUMBER OF MUTUALLY ADJACENT SPINNING POSITIONS OF AN OPEN-END SPINNING MACHINE

BACKGROUND OF THE INVENTION

The present invention relates to a process for servicing a number of mutually adjacent spinning positions of an open-end spinning machine by means of a servicing apparatus for carrying out this process.

Servicing work becomes necessary again and again on open-end spinning machines, and is carried out either in rotation or according to need. For example, the yarn has to be strung up at the beginning of the spinning process or after a yarn break. In a further servicing process, the piecings in the yarn can also be eliminated by a knotting process. Furthermore, the open-end spinning machine has to be serviced as regards bobbin changes and cleaning of the spinning unit, particularly the spinning rotor.

In order to be able to carry out such servicing, various preparatory work has to be undertaken, in order to prepare the spinning position for the servicing process proper. Thus it is necessary to bring the servicing apparatus into the required working position.

An apparatus is known in which a call device built as a yarn monitor is arranged on the machine frame which forms the stationary part of a servicing apparatus, this device causing, by means of a connection switch device, travel of a unit which can be moved by a travel drive along the machine (West German Offenlegungsschrift No. 2,350,840), where it can be stopped by a disconnection switch device brought into a readiness position by the yarn monitor. This unit serves to prepare for piecing of a yarn break. A second unit, which then pieces the broken yarn, is called up by the first unit after the first unit has concluded its work. In the present state of the art, calling is thus effected by the devices monitoring or controlling the machine, which devices can also be released, in fact, by an operator. Such a solution has in practice not been found to be economical, since the cost of materials and time for it is not justified by the saving in manpower which can be achieved. Furthermore, an automatically operating servicing equipment of this type makes possible only a rigid working program, so that either the fault is respectively eliminated at the next adjacent spinning position, or else faults are eliminated in the order in which they occur. In this manner, however, long down-times at many inoperative spinning positions, and unnecessary path times for the servicing apparatus, cannot be avoided. When servicing, e.g., yarn piecing, fails, a manual servicing is necessary after two or three fruitless attempts, so that the operator has to go to the spinning position concerned. Thus, an automatic servicing apparatus cannot completely replace manual servicing.

According to another known process (West German Auslegeschrift No. 2,351,458), to work stages for servicing are divided, so that work requiring special precision is carried out automatically, while the operator carries out the work stages which can easily be carried out manually but however would require complicated apparatus with considerable cost in an automatic version. Thus in the known apparatus the servicing apparatus is brought by hand into the required working position, since a call device is not provided. Then, manually, the bobbin is lifted from the winding roller, the yarn required for piecing is drawn from the bobbin, the yarn is brought to the exact stringup length by parting, the bobbin is deposited on the support, the yarn is deflected via a yarn disposal element, and the yarn end is partially introduced into the spinning unit of the spinning position. Only after these preparatory steps can the servicing proper, namely the release of the yarn which is sucked into the spinning unit, and the lowering of the bobbin which thus causes the resumption of yarn take-off, be automatically carried out.

In a similar manner, before other servicing processes preparatory work is carried out to prepare the spinning position for the servicing, the preparatory work differing according to the servicing to be undertaken.

However, in this known state of the art, the servicing apparatus has to be make ready by hand, in that the operator, when a yarn break occurs, fetches the servicing apparatus or always takes it along with him.

SUMMARY OF THE INVENTION

This problem is solved according to the invention, in that an operator prepares the servicing at the spinning position to be serviced and then calls the servicing apparatus from its current position, upon which the servicing apparatus travels to the operator, close to the spinning position to be serviced and remains there until conclusion of the preparatory work, then the operator brings the servicing apparatus into the exact working position, and sets it in operation, for the initiation and carrying out of the servicing. In this way, the servicing apparatus comes to the operator without the latter interrupting her preparatory work, and without her leaving the spinning position to be serviced, as was necessary when she had to fetch the servicing apparatus. Since the time until the servicing apparatus arrives at the operator is taken up with preparatory work, no lost time occurs during servicing with the servicing apparatus. Vice versa, unncessary path times of the servicing apparatus will be avoided, such as arise from a rigidly structured servicing program. Advantageously, the operator lifts a bobbin from a support and simultaneously calls up the servicing apparatus.

For carrying out the process, there is provided according to the invention a travel drive for the servicing apparatus and having associated with it a switch-on device operable by the operator from each spinning position and also a switch-off device which can travel with the servicing apparatus to halt the servicing apparatus in the neighborhood of the operator.

Since the switch-on device for the travel drive can be released by the operator and not by a yarn monitor or the like, it is ensured that the servicing apparatus travels to where the operator is at the time, without reference to possible further fault positions on the open-end spinning machine. To prevent servicing apparatus running past the operator, a switch-off device for the travel drive is connected to the servicing apparatus, and senses the operator. Thus, when the servicing apparatus arrives in the vicinity of the operator, the switch-off device detects this by sensing the operator and switches off the travel drive, so that the servicing apparatus remains standing in the vicinity of the operator.

So that the travel drive is not interrupted when the operator no longer actuates the switch-on device, a holding device which shunts the switch-on device is expediently associated with the travel drive. In order to be able to interrupt the travel drive from the spinning position to be serviced and thus to half the servicing apparatus, a switch device for each spinning position is provided according to a further feature of the invention, and can interrupt the holding device.

Modern open-end spinning machines possess a large number of adjacent spinning positions. In order to save losses of time which would arise if the direction of travel could be changed by a limmit switch only on reaching an end of a machine, a separate switch-on device is provided for each direction of travel. According to which of the two switch-on devices is actuated, the servicing apparatus then travels to the left or right along the open-end spinning machine, so that it is with the operator needing it within the shortest time. Additional handles for the operator are avoided, according to the invention, in that each of the two switch-on devices has a light beam arranged between one or other end of the open-end spinning machine and the side of the servicing machine facing this end, such that can be broken by the operator while servicing a spinning position, e.g., during preparation for piecing-up a yarn break. According to a preferred embodiment of the invention, each light beam here has a light source and a photocell which are arranged stationary at the end of the open-end spinning machine, and a reflector which can travel with the servicing apparatus.

However, there is also work on the spinning machine for which the servicing apparatus is not required. To exclude a possible interference by the servicing apparatus in this case, the switch-on device can advantageously be rendered inoperative.

Since the servicing apparatus is controlled by the operator and not by the spinning position to be serviced, it must be brought by hand into the exact working position. In order not to have to drive with the whole travel drive in this case, there is preferably provided a coupling which is actuatable simultaneously with the travel drive and which effects a mechanical drive connection between the open-end spinning machine and the servicing apparatus. When the travel drive is switched on, the travel motor is switched on and simultaneously a mechanical drive connection is produced via the coupling between the travel motor and the spinning machine (travel rail). When the travel motor is switched off, this drive connection is also broken again by release of the coupling.

According to the design of the switch-off device for the travel drive, a single switch-off drive can be sufficient. Advantageously, however, a separate switch-off device is provided for each direction of travel, since by this means the servicing apparatus can already be halted shortly before reaching the operator, i.e., near the operator. In order to guarantee the operator an unhindered freedom of movement during servicing of the spinning position, the servicing apparatus should not be located too near the operator, but it must however be already within reach of the operator. For this purpose, the switch-off device for the travel drive is arranged in such a way on the servicing apparatus that it scans the space corresponding to the reach of the operator, in the direction of travel of the servicing apparatus. Advantageously the switch-off device is here designed as an infrared switch, since such a switch serves the operator without contact. When a holding device shunting the switch-on device is associated with the travel drive, and the switch-off device is designed as an infrared switch, the travel drive can only be interrupted by sensing the operator. If however, the operator leaves the scanning region of the switch-off device, the servicing apparatus can run further to the end of the machine and arrive there at full speed. To avoid this, the servicing apparatus has, for each travel direction, according to a further feature of the invention, a limit switch which is connected in controlling relation with the travel drive and which has a respective associated stop at each end of the open-end spinning machine. For many purposes it is advantageous if, in addition, there is associated with the travel drive a further switch-off device to be actuated by the operator and fitted to the servicing apparatus.

Since, as a rule, the operator will undertake servicing work immediately after arrival of the servicing apparatus, it is advantageous if a working drive is switched on simultaneously with halting of the travel drive and then only has to be brought into action by the operator. This happens when the operator releases the servicing work proper, after he has exactly positioned the servicing apparatus for it. For this reason the switch-off device interrupting the travel drive advantageously forms, at the same time, the switch-on device for the working drive of the servicing apparatus, so that the working drive can be brought into action by the operator. In order that the servicing work cannot be disturbed, a holding device shunting the switch-on device is expediently associated with the working drive.

To prevent the first operator's servicing apparatus being fetched away by deliberate or inadvertent actuation of the switch-on device for the travel drive by a second operator during the work of servicing, a safety device which interrupts the travel drive during the period while the working drive is switched on is preferably provided.

If servicing processes are to be carried out at all of the spinning positions along the open-end spinning machine, the servicing apparatus is guided by the operator from spinning position to spinning position. For this it is neither required nor convenient for the travel drive to operate. According to the invention, for such servicing processes a switch device, actuatable by the operator and switching the working drive on, is provided; the travel drive is then interrupted by the safety device.

In order, on the one hand, to exclude switching-on of the travel drive as long as servicing work is in progress, and/or on the other hand to prevent useless running of the working drive, there is provided according to a further feature of the invention a timer unit which can be switched on with the switching-on of the working drive and independently of this when the servicing work is initiated, and by which the working drive can be interrupted after expiry of the allotted time.

Accordingly, it is an object of the present invention to provide a method and apparatus for maximizing the use of a servicing apparatus on an open-end spinning machine and an operator provided for manipulating the service apparatus.

Another important object of the present invention is to provide a drive mechanism for driving the service apparatus to bring the service apparatus to adjacent a spinning position on a spinning machine responsive to receiving a signal so that an operator can properly position the service apparatus relative to the spinning position.

These and other object and advantages of the invention will become apparent upon reference to the following specification, attendant claims, and drawings.

DESCRIPTION OF A PREFERRED EMBODIMENT

If any servicing work should be carried out on the open-end spinning machine, this occurs in rotation or as needed. For servicing in rotation, the servicing apparatus is always located with the operator. For the beginning of the service work in rotation, and for servicing work which arises irregularly, the servicing apparatus is however located on the machine where the last servicing was undertaken.

The kind of servicing plays no part in the scope of the present invention. Thus it may be concerned, for example, with stirring up the yarn at the beginning of the spinning process, or with piecing the yarn after a break; but also a knotting process can be carried out, with the aid of which piecings in the yarn are eliminated. Further examples of servicing are bobbin changing or a cleaning of the spinning unit.

According to the invention, the operator goes, independently of the existing position of the servicing apparatus, to the spinning position requiring servicing and begins the preparatory work for subsequent servicing. Within the scope of these preparatory steps, he suitably summons the servicing apparatus from its present location by means of a signaling device in a suitable manner from the spinning position where the preparatory work is carried out. While the operator is busy with the preparatory work, the summoned servicing apparatus travels automatically to the operator, who halts the servicing apparatus in the neighborhood of the spinning position requiring servicing and at which the operator carries out the preparatory work. Since the servicing apparatus does not halt in the servicing position, but only in the vicinity of the spinning position requiring servicing, the operator is unhindered in her preparatory work, in particular when the servicing apparatus is designed such that it can be halted by the operator without contact. When the operator has concluded the preparatory work, she brings the servicing apparatus into the exact working position, in which the servicing is iniated by the operator, the servicing thenceforth proceeding automatically.

The preparatory work depends on the servicing work. The servicing work can thus include stringup of the yarn, opening of the spinning housing, and the like. It has been found that the bobbin must be lifted from its support at the beginning of the servicing work, independently of the servicing to be carried out. Therefore, according to the invention, summoning of the servicing apparatus advantageously occurs in connection with such a lifting of the bobbin from the support, in that, for example, a corresponding switch is associated with the bobbin arm.

The process according to the invention makes it possible in a simple way for the work processes which can be effected manually in a particularly economical way are carried out by the operator, while the time-intensive work processes and those which require special precision proceed automatically after release by the operator.

Figure 1:
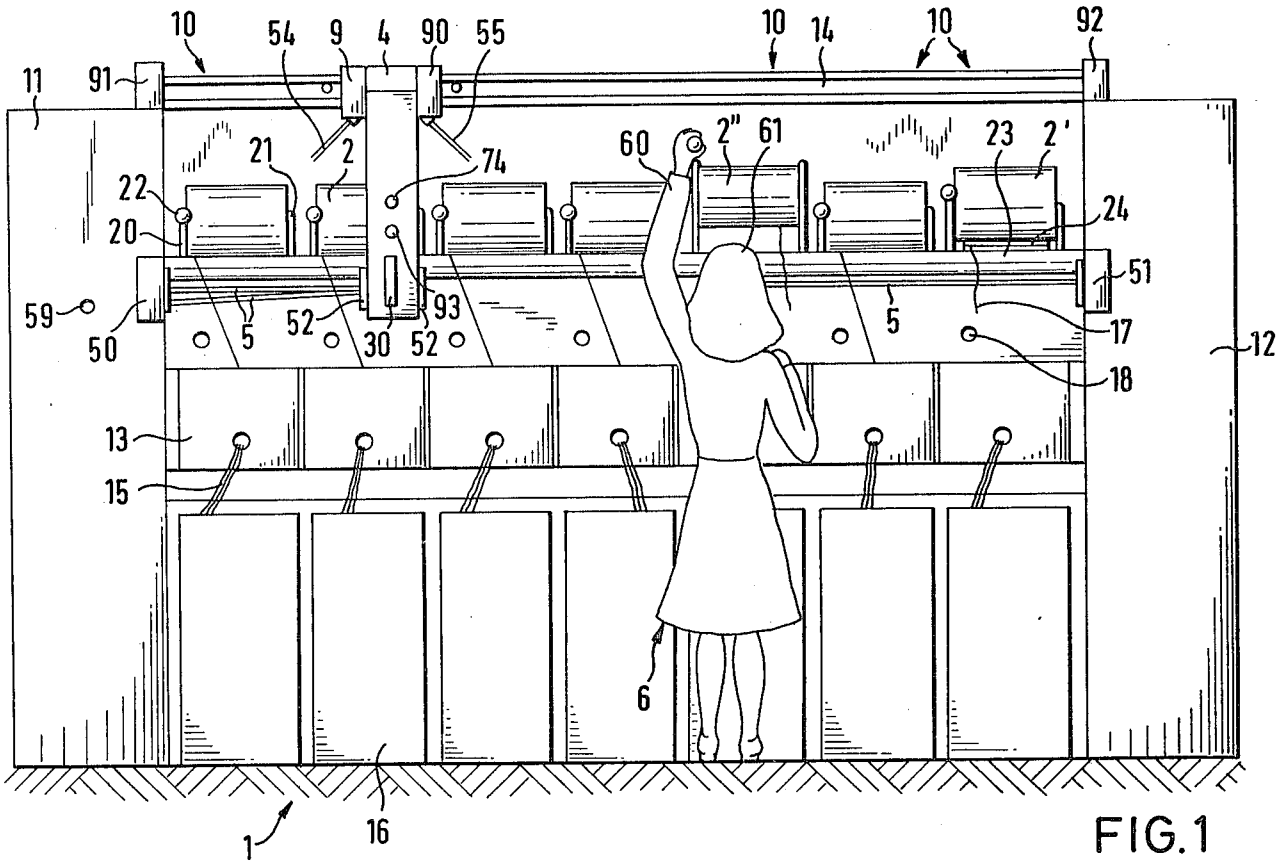
FIG. 1 is a front elevational view of an open-end spinning machine according to the invention.
Figure 2:
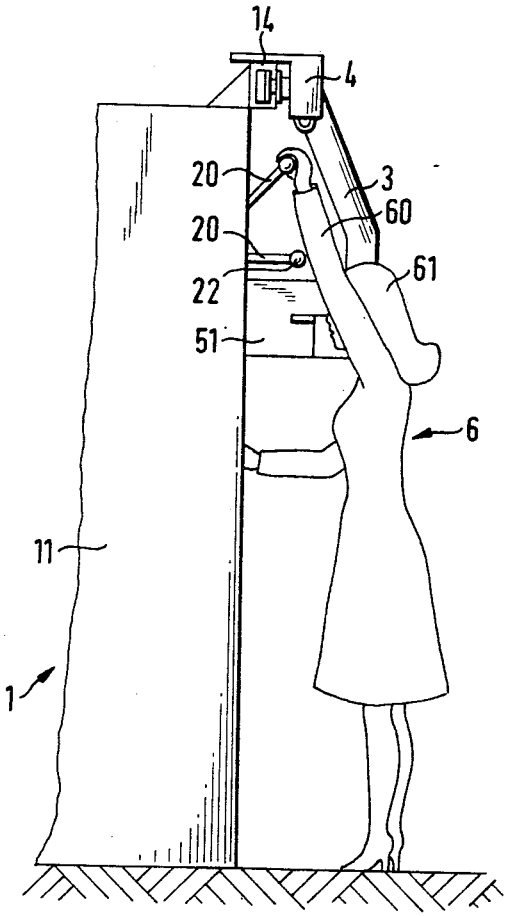
FIG. 2 is a side elevational view of the open-end spinning machine shown in FIG. 1.

The object of the invention will be illustrated below by means of special embodiments. An open-end spinning machine 1 designed according to the invention is shown in FIGS. 1 and 2. The spinning machine shown has seven spinning positions 10; in practice, however, these would however be considerably more in number. The spinning machine itself is shown only diagrammatically, all elements not absolutely necessary for the understanding of the invention being left out for the sake of clarity.

The open-end spinning machine 1 has at each end 11 and 12 an end frame, one of which receives the drive. Between the ends 11 and 12, the spinning machine has one spinning unit, covered by a lid 13, per spinning position; each unit is supplied by a spinning can 16 with the fiber material 15 to be processed. The yarn 17 spun in the spinning unit is drawn out and wound on a bobbin 2, which is held between two pivotable bobbin arms 20 and 21 and driven by a drive shaft 23 which extends over the whole length of the machine. A changing apparatus is of course also supplied, and is of a known design. The bobbin arm 20 is provided with a handle 22, so that by pivoting the bobbin arm 20 upward the bobbin 2 can be lifted from the drive shaft 23 (position 2″).

Both ends 11 and 12 of the open-end spinning machine 1 are connected together by a rail 14, on which a servicing apparatus can travel by means of a travel unit 4 (FIG. 3) along the machine. The travel unit 4 has, for this purpose, a travel drive 40 which will be further described below.

A projecting holder 50 and 51 is provided at each end 11 and 12 of the open-end spinning machine 1, so that the servicing apparatus 3 is located between the two holders 50 and 51. Each holder receives a light source (not shown) and also a photocell (likewise not shown). At its sides facing the ends 11 and 12 of the spinning machine 1, the servicing apparatus 3 has a respective reflector 52. Each light source thus produces a light beam 5, which, when not interrupted, is reflected by the reflector 52 and reaches the photocell in the holder 50 or 51.

The servicing apparatus 3 further has an infrared switch 53 for each spinning position (FIG. 4), as indicated by rays 54 and 55 (FIG. 1).

The apparatus according to the invention, the preferred embodiment of which has been described above, operates as follows:

The operator 6 tending the open-end spinning machine 1 establishes that a yarn break has occurred, a bobbin 2 is to be changed, or that some other servicing procedure is to be undertaken at one of the spinning positions 10. Possibly the operator 6 is apprised of this by an optical or acoustic indicator device (not shown). The operator 6 approaches the spinning position 10, where she lifts the bobbom 2 from the drive shaft 23. In doing so, the operator 6 moves her arm 60 or head 61 into the region of the light beam 5, which is hence interrupted (see right-hand side of FIG. 1). As a result, the travel drive 40 (FIG. 3) is set in operations, and then moves the servicing apparatus 3 in the direction towards the operator 6. When the servicing apparatus 3 comes into the vicinity of the operator 6, the latter comes within the scanning region of the forward-running infrared switch 53, which now stops the travel drive.

The servicing to be undertaken is, for example, elimination of a yarn break with subsequent parting of the piecing region and its replacement by a knot. When a yarn break occurs, the feed of fiber material 15 into the spinning unit is interrupted, in the usual manner, by a yarn monitor (not shown). The yarn monitor simultaneously interrupts the windup of yarn 17 onto the bobbin 2; for example, this occurs by a bobbin support element 24 being pushed between the drive shaft 23 and the bobbin 2. The bobbin 2 thus arrives in position 2' (FIG. 1). The operator 6 now pulls a sufficiently long yarn end from the bobbin 2, and moreover lifts the bobbin 2 from the bobbin support element 23 (position 2''). As a result, however, she now has her body in the region of the light beam 5, which she interrupts.

The yarn end drawn from the bobbin 2 is now brought by parting to the exact length required for satisfactory stringing up. By lowering the bobbin 2 onto the bobbin support element 24, the yarn end which has meanwhile been inserted into the spinning apparatus is now fed back into the spinning unit. The resumed yarn tension causes the yarn monitor to switch on again the supply of fiber material 15 into the spinning apparatus. The newly produced yarn 17 is now guided away by means of an auxiliary suction unit 18.

During all this work, the operator 6 is in the region of the spinning position 10, so that she is sensed by the nearby servicing apparatus 3. In the vicinity of the operator 6, the servicing apparatus 3, designed in this case as a knotting apparatus, is halted. Thus it is already within the reach of the operator 6, without hindering her.

Figure 4:
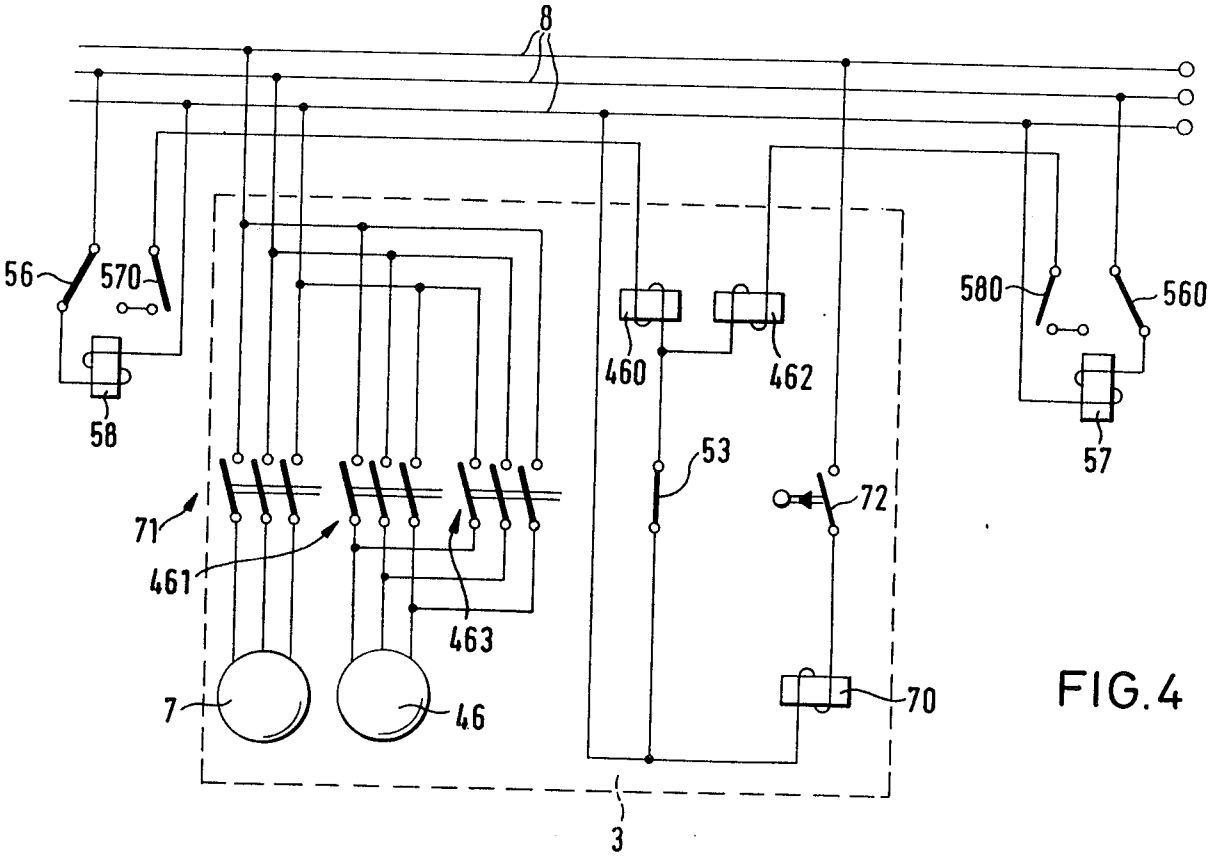
FIG. 4 is an elevational schematic diagram for a control device utilized with the servicing apparatus.

After the preparatory work of yarn break elimination, the operator 6 now undertakes the parting of the piecing region by knotting. She grips the servicing apparatus 3 by its handle 30 and positions it by pushing it along the machine. In the exact working position, the servicing apparatus 3 is, for example, moved by hand transversely of the machine, whence the servicing process is automatically initiated and carried out by switching on a working drive (FIG. 4). Simultaneously the bobbin support element 24 is pulled away from under the bobbin 2, so that windup also restarts.

The servicing apparatus can also be controlled in a similar manner when designed as a bobbin changer. For example, for the next bobbin change, the respective bobbin 1 is lifted into position 2'', upon which a light beam 5 is interrupted, so that the servicing apparatus 3 is summoned in the direction of the spinning position 10 needing it. After manual positioning, the operator 6 releases the bobbin change proper.

The switch-on apparatus for the travel drive 40, formed by the light beam 5, is thus released by the operator 6. The travel drive 40 is switched off by a switch-off apparatus, which is constructed in the embodiment shown as an infrared switch 53 and which can travel with the servicing apparatus 3, so that it senses the operator 6 when she comes close.

In the embodiment described, a separate switch-on device is provided for each travel direction of the servicing apparatus 3, one formed by the light beam 5 to the left of the servicing apparatus 3 and the other by the light beam 5 to the right of the traveling servicing apparatus 3. These two light beams 5 are connected to the travel drive such that when the right-hand light beam 5 is interrupted the travel drive is set in action for a motion towards the right, and on interruption of the left-hand light beam 5 the travel drive 40 is set in action for a motion towards the left. This is particularly advantageous, since in this way it is arranged that the servicing apparatus travels to the operator 6 by the quickest path.

When two separate switch-on devices are dispensed with, the servicing apparatus 3 can only travel in one preset direction. A changeover to the opposite direction can here take place, for example, by arrival at a limit switch on a stop at the end 11 or 12 of the open-end spinning machine 1, but in such a case more time is required than with two switch-on devices.

The switch-on device or switch-on devices can be designed in various ways. For example, this purpose is servied by a tension cable, with which a switch is actuated, or by an air tube, in which the cross section is reduced by a press button or the like, a switch being likewise actuated by the air expelled in this way. For example, the tension cable actuates a first switch when tension is applied to it in one direction, and a second switch when tension is applied in the opposite direction. Alternatively, each desired direction of travel of the servicing apparatus 3 may be provided with its own tension cable, its own air tube, or an electric switch of its own. It is also possible to provide a changeover switch which can be moved from a middle position in one of two opposite directions. In all the embodiments described above, the switch-on device is switched on by being acted on by the operator or be operable within the reach of the operator, for example, for every two spinning positions 10.

When, however, the switch-on device works without contact, as when it works with the light beams 5 in the embodiment described before, the operator can be completely occupied with the preparation for the servicing without having to worry about the whereabouts of the servicing apparatus 3. This light beam is arranged such that it has to be interrupted by the operator 6 when carrying out her work, since she is always, for this work, in the region of the light beam 5 between the holder 50 or 51 and the servicing apparatus 3.

In order to keep the working forces for the servicing apparatus 3 and also to keep the forces to be applied by the operator 6 as small as possible, the elements of the light beam 5 requiring an electric circuit are expediently arranged stationary at the ends 11 and 12 of the open-end spinning machine 1. Thus the light sources (not shown) and also the photocells (not shown) are located in the holders 50 and 51, while the servicing apparatus is solely furnished with a reflector 52 for each light beam 5.

Just as with the switch-on device for the travel drive 40, the switch-off device can also be designed in various ways. In the embodiment shown, a separate switch-off device is provided for each direction of travel. This makes it possible to halt the servicing apparatus 3 before reaching the operator. For example, for this purpose, a longer, depending arm (not shown) is provided at each end of the servicing apparatus 3 and forms a part of a switch, and on actuation by pivoting actuates this switch, so that the travel drive 40 is halted. So as to ensure that the stationary servicing apparatus does not hinder the operator 6 in her work, the arrangement of the switch off device is such that the servicing apparatus 3 does not first come to a standstill in the immediate neighborhood of the operator, but stops earlier than this, though it is already within reach of the operator 6. For example, the travel unit 4 is so long that the dependent arm of the switch of the servicing apparatus 3 leads by a corresponding distance. According to the preferred embodiment, the switch-off device is designed as an infrared switch 53, since this is actuated without contact. Thus hindering of the operator 6, which is possible in the case of a switch-off device operating by means of a depending switch arm, no longer occurs. The infrared switch 53 is oriented so that it scans the space in the travel direction of the servicing apparatus, to the extent of the operator's reach.

If now only a single switch-off device is provided, to halt the travel drive 40 independently of the direction of travel of the servicing apparatus 3, the servicing apparatus 3 travels until it is directly at the position of the operator 6, and can thus in some circumstances hinder her. Therefore, a switch-off device is expediently provided for each travel direction, to scan the space at the reach of the operator 6.

Since positioning of the servicing apparatus 3 after it is halted near the operator 6 is carried out by hand, it is particularly advantageous if the force to be applied to move the apparatus is as small as possible. For this purpose, the mechanical drive connection between the open-end spinning machine 1 and the servicing apparatus 3 can, according to the invention, be removed. The travel unit 4 has, as in FIG. 3, wheels 41 by means of which the travel unit 4 is guided in a C-shaped track. To prevent tilting of the travel unit 4, further support wheels 42 are provided, supported from the inside of the track 14. These wheels 41 and 42 are sufficient for guiding the travel unit 4, and thus the servicing unit 3, along the machine. Friction wheels 43 are provided for the drive of the servicing apparatus 3, and are mounted in a bearing 44 and driven via a transmission 45 from a travel motor 46. The travel motor 46, together with the transmission 45, bearing 44 and friction wheels 43 forms a unit, which is guided, and is vertically adjustable, in a vertical guide 47. The guide 47 is attached to the travel unit 4 by means of a stationary mounted 470. This mounting furthermore carries a vertically arranged electromagnet 48. The armature 480 of this electromagnet carries a clamping ring 481, on which is supported a compression spring 482. This compression spring 482 is guided in the axial direction by the armature 480 and is supported by its other end on a support plate 440 which is connected to the bearing 44. On the side of the support plate 440 remote from the compression spring 482 there is supported a second, considerably weaker compression spring 483, the other end of which is supported on the floor 400 of the travel unit 4. This compression spring 483 is guided in the axial direction by a bolt 484.

If the travel drive 4 is actuated, i.e., if the travel motor 46 is switched on, the electromagnet 48 is simultaneously excited. This pushes its armature 480 downwards, and the clamping ring 481 of the armature loads the compression spring 482. The compression spring 483 thus presses downward, via the support plate 440, the bearing 44 with the friction wheels 43 and the transmission 45, together with the travel motor 46, while the compression spring 483 is prestressed. The friction wheels 43 thus lie on the rail 14 and, because of the torque produced by the travel motor 46, drive the servicing apparatus 3 in the selected direction of travel. A mechanical drive connection between the open-end spinning machine 1 and the servicing apparatus 3 is thus effected by this apparatus. By elastically pressing the friction wheels 43, moreover, irregularities in the track can be compensated for.

If the travel drive 40 is switched off by switching off the travel motor 46, the electromagnet 48 shuts off. The compression spring 482 relaxes as a result, and via the clamping ring 481 pushes the armature 480 upwards. Simultaneously, however, the compression spring 483 can also relax, and now, via the support plate 440, raises the bearing 44 with the friction wheels 43 and the transmission 45 together with the travel motor 46. In this way the friction wheels 43 are lifted from the track 14, so that the machanical drive connection between the servicing apparatus 3 and the open-end spinning machine 1 is removed. If now the servicing apparatus 3 is manually pushed along the spinning machine, the travel unit rolls along the rail 14 with the aid of the wheels 41 and the support wheels 42, without the travel drive 40 also having to be driven.

The electrical connection diagram for the apparatus according to the invention will now be explained with the aid of FIG. 4. A working drive 7 is connected, via the contacts 71 of a relay 70, to a main supply 8, which for example, is designated as a three-phase mains. The travel motor 46 is also connected to the same mains supply 8 via the contacts 461 of a relay 460. Further contacts 463 of a relay 462 are in parallel with the contacts 461, so that the phases of the mains 8 reach the travel motor 46, via the contacts 463, interchanged with respect to the supply via the contacts 461. Hence the travel motor 46 is driven conventionally in one direction, for example to the left with respect to FIG. 1, via the contacts 461, and in the opposite direction, for example to the right with respect to FIG. 1, via contacts 463. Relay 460 is arranged in a circuit between two phases in series with a changeover switch 56 and a contact 570, while the relay 462 is arranged in parallel with these elements, in series with a changeover switch 560 and a contact 580. Both relays 460 and 462 are, in common, connected in series with the infrared switch 53. Likewise, a switch 72 and the relay 70 are arranged between two phases.

A relay 58 is provided in parallel with the contact 570, with the relay 460, and with the infrared switch 53; it can be controlled by the changeover switch 560 and controls the contact 580. In a similar manner, a relay 57 is provided in parallel with the contact 580, the relay 462 and the infrared switch 53; it is controlled by the changeover switch 56 and controls the contact 570.

Figure 3:
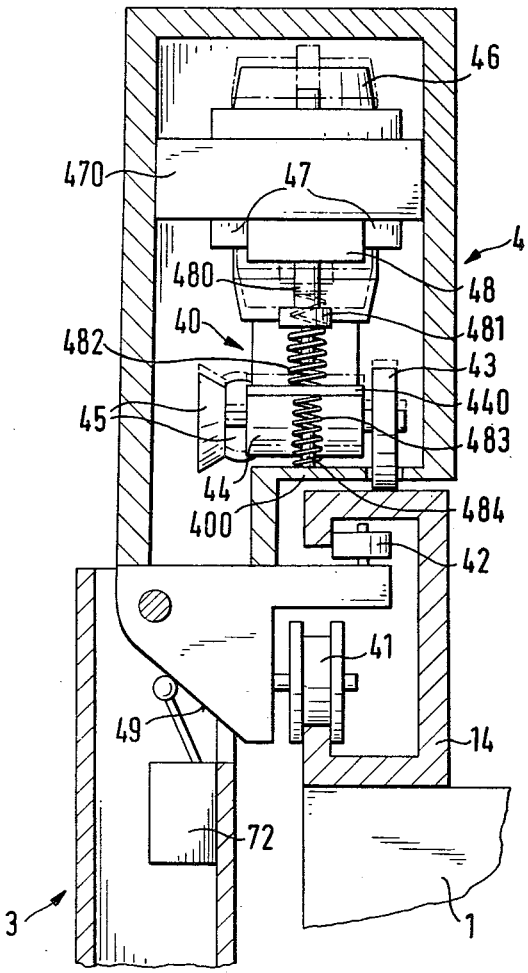
FIG. 3 is in cross-section, a detail of the travel equipment of the servicing apparatus acccording to the invention.

As described above, the working drive 7 is actuated, for example, by motion of the servicing apparatus 3 transversely of the open-end spinning machine. For this purpose, the servicing apparatus 3 can be displaceable in a guide, or else, as shown in FIG. 3, can be attached, via a shaft 31, pivotably to the travel unit 4, with the travel unit 4 bearing a switch cam 49 and the pivotable servicing apparatus 3 bearing a switch 72 which cooperates with this switch cam 49.

Since neither of the light beams 5 is interrupted, both relays 57 and 58 are normally excited, and hold their contacts 570 and 580 closed. The light beams 5 control both the changeover switches 56 and 560. If the right-hand light beam 5 is interrupted (see FIG. 1), since the operator 6 is working on this side of the servicing apparatus 3 on a spinning position 10, the changeover switch 560 connects the mains 8 via the closed contact 580 to the relay 462. This relay 462 then closes its contact 463 and switches on the travel motor 46, which is connected via the contacts 463 for running to the right. The servicing apparatus 3 thus travels towards the operator until the infrared switch 53 detects the operator 6 by means of its beam 55 and interrupts the current through the relay 462 so that the contacts 463 open and halt the travel motor 46. The servicing apparatus thus stays still before it reaches the operator 6, but within her reach. The operator 6 now takes the servicing apparatus 3 by the handle 30 and moves it into the exact working position, where she actuates the switch 72 by pivoting of the servicing apparatus 3 as a result of the relative motion between switch cam 49 and switch 72 (FIG. 3). Hence relay 70 is excited, and switches on the working drive 7 via the relay's contacts 72. By pivoting the servicing apparatus 3 back after conclusion of the servicing work, the switch 72 is released again by the switch cam 49, so that the relay 70 is deactivated, opening its contacts 71 and switching off the working device 7.

By actuation of the changeover switch 560 the relay 57 is deprived of current, and its contacts 570 thus open. Thus the relay 460 cannot be switched on as long as relay 462 is switched on, and vice versa. Relays 57 and 58 thus form a safety device and serve for reciprocal locking of relays 460 and 462. In this way the servicing apparatus 3 is prevented, while being driven in one direction, from being commanded to travel in the opposite direction.

Figure 5:
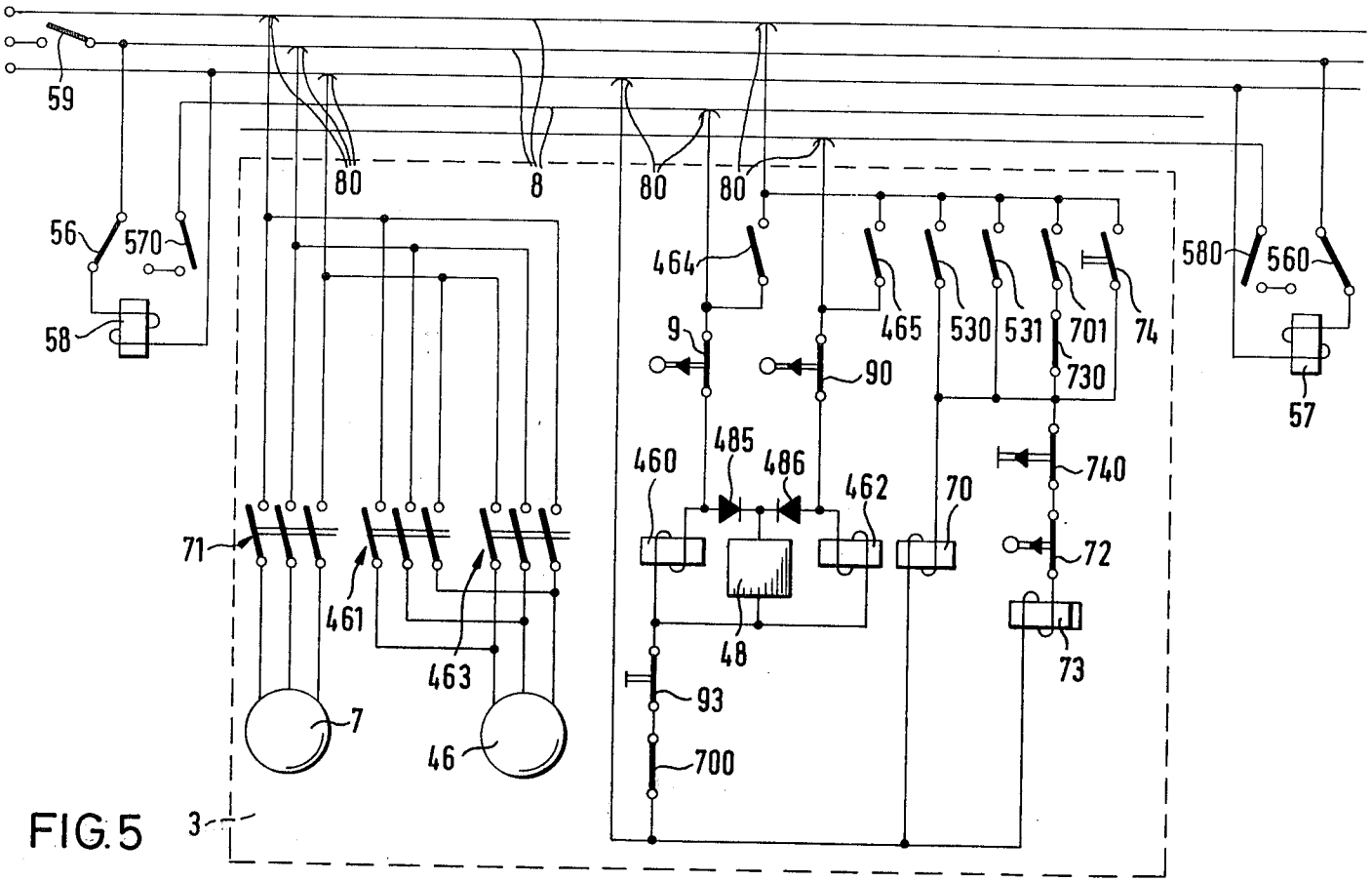
FIG. 5 is an electrical schematic diagram according to a preferred embodiment of the apparatus constructed according to the invention.

Since as a rule the operator 6 has already completely or nearly completed here preparatory work for the servicing process when the servicing apparatus 3 arrives, it is advantageous if the working drive 7 is now also switched on, so that the operator initiates the carrying out of the servicing process solely by taking hold of the apparatus. For this purpose, the switch-off device interrupting the travel drive 40, e.g., the infrared switch 53, is according to the invention simultaneously the switch-on device for the working drive 7. Such a modification of the object of the invention is shown in FIG. 5. Instead of the switch 72 there are provided in this case, in the circuit of the relay 70, two parallel contacts 530 and 531 of the infrared switch 53, which contacts are normally open, but which are closed on interruption of the beam 54 or 55 (FIG. 1) of the infrared switch 53. Here each contact 530 or 531, respectively, corresponds to a beam 54 or 55 and thus to a direction of travel. As long as the operator 6 is within the sensing region of one of the beams 54 and 55 (FIG. 1) of the infrared switch 53, the travel drive 40 is switched off.

The contact 530 of the infrared switch 53 can also be arranged in parallel with the switch 72, so that the operator 6 can also leave the scanning region of the infrared switch 53 after actuating the switch 72, without the working drive 7 being interrupted.

So that the travel drive 40 can also not be switched on after release of the infrared switch 53, with the working drive 7 still switched on, a safety device 700 is advantageously provided to interrupt the travel drive during the period for which the working drive 7 is switched on. This safety device 700 is formed by a contact of relay 70, which is arranged in series to the parallel combination of relays 460 and 462. Thus if relay 70 if excited for switching on the travel drive, this opens the contact 700 forming the safety device, so that the travel drive cannot be switched on either via relay 460 or via relay 462.

Advantageously, a self-holding device shunting the switch-on device (contacts 530 and 531 of the infrared switch 53) is provided, and is formed by a contact 701 of relay 70, arranged in parallel with contacts 530 and 531. Hence this contact 701 keeps the relay itself excited, when the infrared switch 53 is no longer actuated. A timing unit 73 is provided in parallel with the relay 70 and, after expiry of an alloted time which it sets, cuts off the current again from the working drive 7. This timing unit 73 is switched on just as is the relay 70, by contact 530 or 531, and is held by contact 701. The timing unit 73 has a contact 730 is parallel with the contacts 530 and 531 and in series with relay 70 and with the timing unit 73; this contact 730 is normally closed. However, after the time preset by the timing unit 73, the contact 730 is opened and hence the supply of current to relay 70 and to the timing unit 73 is interrupted. The working drive 7 is thus switched off. With the timing unit 73 is furthermore associated a switch device which inactivates the timing unit 73 on initiation of the servicing work. Preferably this switching device is formed by switch 72 (FIG. 3), which in this case is connected in series with the contacts 530, 531, 701 and 730, in the circuit of the timer unit 73, which is in parallel with the relay 70. Therefore, on pivoting of the servicing apparatus 3 into its working position simultaneously with the release of the servicing work by closing of switch 72, the current supply to the timer unit 73 is interrupted, so that this is inactive and is reset to zero.

The timer unit 73 has the purpose of ensuring that the working drive 7 is not immediately switched off after the infrared switch 53 is no longer actuated. This is the case when the operator 6 takes a step back from the machine, in order to bring the servicing apparatus into the exact working position by moving it along the open-end spinning machine, since the operator 6 thus moves out of the region of the beams 54 and 55 of the infrared switch 53. The safety device 700 also prevents the servicing apparatus 3 being summoned away from the operator during this time by any other person who may come into the region of one of the two light beams 5.

For example, the timing unit 73 allows a time of twenty seconds. When the operator 6, after response of the timer unit 73 and the relay 70 for the working drive, has left the region of the beams 54 and 55 of the infrared switch 53 within these twenty seconds, and the servicing work has not begun by actuation of the switch 72, the contact 730 opens a short time afterwards and the working drive 7 is switched off. Contact 730 then closes again. Since in the meantime the contact 701 of relay 70 has opened, the current supply remains interrupted both to relay 70 and also to the timing unit 73.

In this way, unnecessary work of the working drive 7 is avoided when the operator is prevented from immediately undertaking the servicing work to be carried out with the servicing apparatus 3. By actuation of the infrared switch 53, which can be effected by the operator 6 by briefly placing her hand in the region of beams 54 and 55 or by going into this region, the working drive 7 is again switched on when the operator 6 finally wishes to undertake the servicing work.

Simultaneously with switching off of the working drive 7 after expiry of the period allotted by the timing unit 73, the travel drive 40 is released by the safety device 700. When the operator 6 has left the spinning position 10, she can call the servicing apparatus to her at another spinning position 10 by again interrupting one of the light beams 5.

If on the other hand the operator 6 takes hold of the servicing apparatus 3 within the preset twenty seconds and, by pivoting or displacing it, actuates the switch 72, thus simultaneously releasing the servicing work itself, the timing unit 73 is again activated, independent of the timer period still remaining. After completion of the servicing work, the alloted period of the timing unit 73 begins to run by closing of switch 72. Only after expiry of this period is the working drive 7 switched off by opening of contact 730 and the travel drive 40 released by means of the safety device 700.

According to the preferred embodiment of the invention, the servicing apparatus shown enclosed in dashed lines is not as shown in FIG. 4, permanently connected by its terminals to the mains 8 (via pulled out cable, which may automatically be wound up), but sliding contacts 80 are provided for this purpose.

So that the operator 6 is not constrained to remain constantly in the region of the light beam 5 during the preparation of the servicing work, self-holding contacts 464 and 465 are provided for relays 460 and 462, and shunt the changeover switches 56 and 560 forming the switch-on device, and hold the respective relay 460 and 462 itself still excited until the relay 460 or 462 is deprived of current by response of infrared switch 53. In this way it is ensured that the servicing apparatus 3 is already at the position of the operator 6 on completion of the work (e.g., bobbin lifting, yarn stringup) preceding the servicing work proper.

Figure 6:
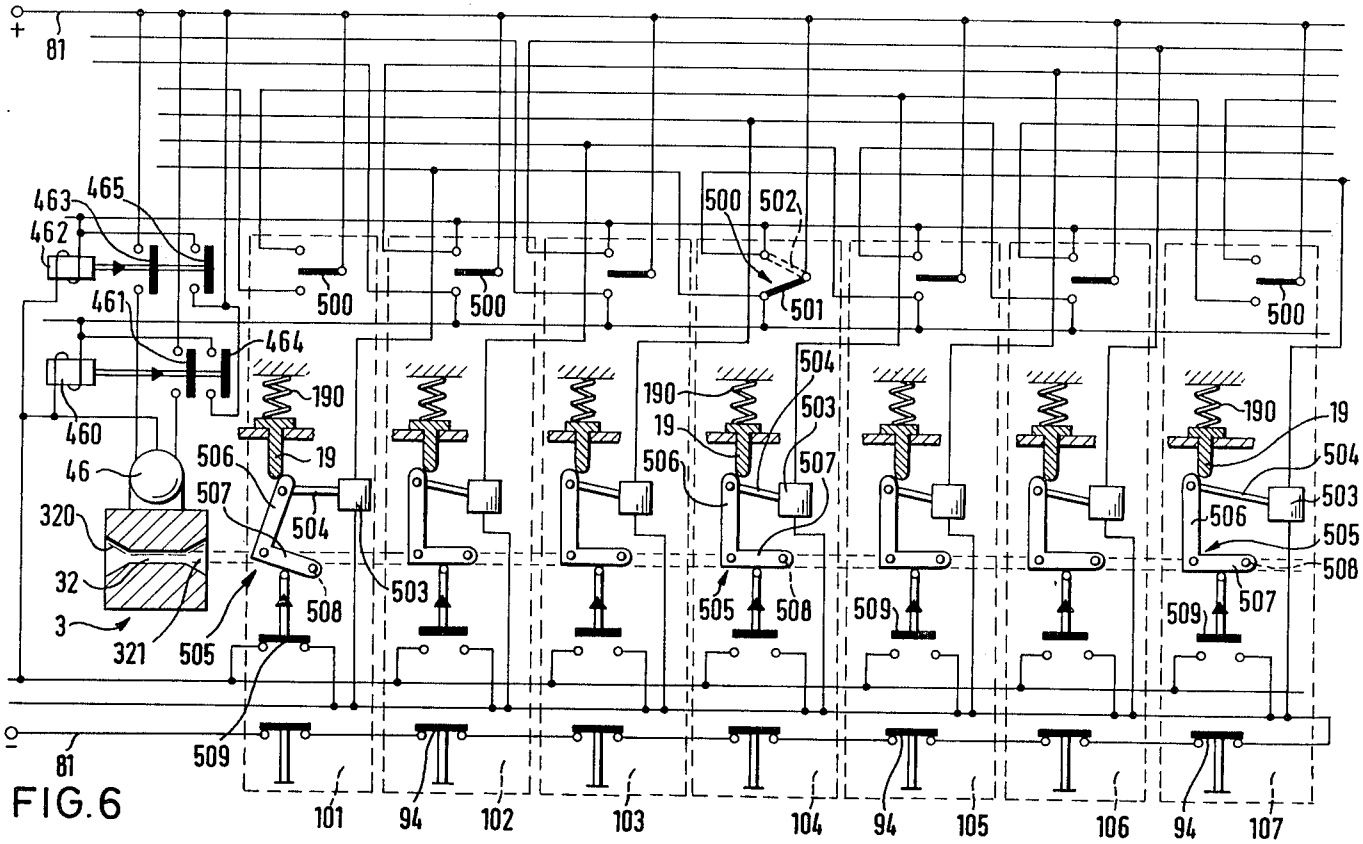
FIG. 6 is a schematic diagram of a modified form of the invention in which halting of the servicing apparatus occurs independently of the operator.

To prevent the servicing apparatus 3 running away to the end of the open end spinning machine 1 when the operator 6 leaves the scanning region of the infrared switch 53, a limit switch 9 or 90 is respectively provided at each side of the servicing apparatus 3 or of its travel unit 4, and is connected in control relation with the travel drive 40 (FIGS. 1 and 6). The limit switch 9 is in series with the relay 460, and the limit switch 90 is in series with the relay 462, so that the two limit switches 9 and 90 are in two parallel circuits. A respective stop, 91 or 92, arranted at the end 11 or 12 of the open-end spinning machine 1 is associated with each limit switch 9 or 90. If the servicing apparatus 3 reaches the stop 91 with its limit switch 9, or the stop 92 with its limit switch 90, the corresponding limit switch 9 or 90 opens and interrupts the supply of current to the respective associated relay 460 or 462, so that the servicing apparatus 3 is halted before it contacts the end 11 or 12 of the open-spinning machine 1.

So that the servicing apparatus 3 can be halted independently of the automatic control in special cases, a switch-off device 93 to be actuated by hand is associted with the travel drive 40 and is provided on the servicing apparatus 3 itself (FIGS. 1 and 6). This switch-off device 93 is rranged in series with the parallel combination of relays 460 and 462.

The electromagnet, shown in FIG. 3, which effects or cancels the mechanical drive connection between the open-end spinning machine 1 and the servicing apparatus 3, is connected in parallel to the two relays 460 and 462; diodes 485 and 486 prevent relays 460 and 462 being simultaneously addressed.

For given servicing or repair work on the open-end spinning machine 1, it is troublesome if the servicing apparatus 3 is summoned with the interruption of one of the light beams 5. For this purpose, the phase of the supply mains 8 to which the light beams are connected has an associated switch 59, so that the switch-on device formed by the light beams 5 can be rendered inoperative.

If servicing work is to be carried out on successive adjacent spinning positions 10, the travel drive 40 is not required, since the servicing apparatus 3 is moved from spinning position 10 to spinning position 10 by the operator 6. In order to exclude in this case any influence by other persons on the open-end spinning machine, there is advantageously provided, in parallel with the contacts 530, 531 and also 701 and 730, a switch device 74 for actuation by hand to switch on the relay 70. To prevent a simultaneous actuation of the timer unit 73, a further contact 740 of the switch device 74 is provided in parallel with the relay 70, but, however, in series with the timer unit and with the switch 72.

The switch 74 excites relay 70, which switches on the working drive 7 via the relay 70, and by means of the safety device 700 separates the travel drive 40 from the mains supply 8. Only by interrupting the flow of current via switch device 74 can the working drive 7 be switched off again and the travel drive 40 and also the timing unit 73 released again.

The above description shows that the invention can be utilized in numerous ways. This it is also possible, for example, to provide several switch-off devices for each direction of travel, for the travel drive 40, by the first of which devices the speed of travel of the servicing apparatus 3 can be slightly reduced via a transmission, and the travel drive only being switched off by the second switch-off device. The foupling effecting the mechanical driving connection between the open-end spinning machine 1 and the servicing apparatus 3 can, for example, also be designed as a balance beam, which has a friction wheel 43 at each end, these friction wheels being driven in different directions. According to the desired direction of transportation, the balance lever is brought from a neutral middle position in which neither of the friction wheels 43 contacts the rail 14, into an end position in which one or other of the friction wheels makes contact with the rail 14. Of course, a gearwheel can also be provided instead of the friction wheel 43, in which case the track 14 has a corresponding toothing.

It is also possible, instead of a single timing unit 73 which is switched on by the switch-on device for the working drive 7 or during the carrying out of the servicing process, to provide two separate timing units, one of which can be switched on sumultaneously with the working drive and the other with the carrying out of the servicing work, so that different times can also be preset for this The manner in which, after switching on the working drive 7, the servicing work proper is initiated and carried out is not an object of the present invention and depends on the nature of the servicing. For example, the servicing work can be initiated by actuation of a switch 72 by pivoting or displacement of the servicing apparatus 3 transversely of the open-end spinning machine 1. Such a switch 72 can, however, also be actuated by hand and can, for example, be arranged in the handle 30 (FIG. 1). The switch 72 can also be designed differently, for example, as a magnetic switch.

The manner in which the servicing apparatus 3 is halted in the vicinity of the operator 10 can be accomplished by any suitable conventional equipment. According to the embodiments of the object of the invention as described above, the servicing apparatus 3 is halted by sensing of the operator 6. FIG. 6 shows another design of the apparatus according to the invention in which the servicing apparatus is indeed summoned by the operator 6, but is halted in her vicinity independently of her.

In FIG. 6 are shown seven spinning positions 101 through 107 of a considerably greater number of spinning positions possessed by an open-end spinning machine, all the positions being constructed alike both mechanically and electrically. At each spinning position there is one of the switches 500 actuatable by the operator; each switch can assume, apart from its middle setting which it assumes in the embodiment shown at spinning positions 101, 102, 103, 105, 106 and 107, also a first switch setting 501 (see spinning position 104) and a second switch setting 502 (see spinning position 104, dashed setting). The switch position 501 is for summoning the servicing apparatus 3 in the travel direction from left to right, while the switch setting 502 is for summoning the servicing apparatus 3 in the travel direction from right to left, as will be further explained below.

Each spinning position 101 through 107 furthermore has an electromagnet 503, which is connected in control relation with a switch 500. According to how many spinning positions before reaching the spinning position to be serviced the servicing apparatus 3 is to be halted, the switch 500 of a given spinning position and the electromagnet 503 of, for example, the two or three spinning positions before and after this given spinning position belong together. In the example shown, the servicing apparatus is to be halted three spinning positions before reaching the spinning position to be serviced. For this reason, the switch 500 of spinning position 104 cooperates with the electromagnet 503 of spinning positions 101 and 107.

Each electromagnet 503 is connected via its armature 504 with an arm 506 of an angle lever 505, while the other arm has a positioning pin 508 by means of which the angle lever 505 can be reset into its initial position, through a reset guide 32, having a widened end 320 and 321 on each side, in the servicing apparatus 3. The angle lever 505 cooperates with a switch 509 which is open in the initial position of the angle lever 505 and is closed in the pivoted position of the angle lever 505.

The angle lever 505 has an associated latch bolt 19 acted on by a compression spring 190 and latching, according to the setting of the angle lever 505, on one or other side of the arm 506 of the angle lever 505. The action of the compression spring 190 on the latch bolt 19 in fact is sufficient to secure the angle lever 505 in the setting at any given time, but on actuation of the electromagnet 503 and upon action of the reset guide 32 in the servicing apparatus 3 on the positioning pin 508 of the angle lever 505, permits a pivoting of the latter.

Each electromagnet 503 is connected to two switches 500, which at any given time are spaced, corresponding to the selected distance from the spinning position to be serviced for the halting of the servicing apparatus 3, several spinning positions from this position. In the example shown, this spacing amount to three spinning positions, on account of which the electromagnet 503 of spinning position 104 is connected with switch 500 in the switch position 502 of spinning position 101 and the switch 500 in switch position 501 of spinning position 107.

In a similar manner, the other switches 500 and electromagnets 503 are connected together.

In switch position 501, switch 500, the pivot point of which is, for example, connected to the positive pole of a control lead 81, excites a relay 460 which also remains excited via an auto-hold contact 464 after return of switch 500 into the original position. In like manner the switch 500, in switch setting 502, excites a relay 462 which is kept excited by an auto-hold contact 465. On excitation, the relay 460, by means of its contact 461, connects the travel motor 46 with the control lead 81 such that the travel motor 46 is switched on for travel to the left.

The switches 509 of the individual spinning positions 101 through 107 are all connected in parallel. The relays 460 and 462 can only be connected via one of these switches to the minus pole of the control lead 81, so that the travel motor 46 can only be set in operation when one of the angle levers 505 assumes its pivoted position.

If desired, a switch 94 can be provided for each spinning position, in series with the parallel-connected switches 509, in order in this way to halt the servicing apparatus 3 in the present position, without the operator 6 having to leave the spinning position to be serviced.

If the operator 6 is at spinning position 104 to carry out servicing, and if the servicing apparatus 3 is to her left, the operator moves the switch 500 briefly into switching setting 501 as part of the preparatory work for the servicing. The electromagnet 503 of spinning position 101 is thus actuated, and pivots the angle lever 505 from the initial position into the working position, in which it closes the associated switch 509. Simultaneously with the electromagnet 503, the relay 460 is excited and, after release of switch 500, is kept excited via the auto-hold contact 464 and, via its contact 461, switches on the travel motor 46 for travel to the right. Since switch 509 is closed, the servicing apparatus 3 is set in motion until the reset guide 32 provided on the servicing apparatus 3 returns the angle lever 505, via the positioning pin 508, to its initial position, so that the switch 509 is opened. The current flow through the relay 460 and the travel motor 46 is hence interrupted, and the servicing apparatus 3 remains standing three spinning positions from the operator 6.

In a similar manner, the operator can summon the servicing apparatus which is to her right. Switch 500 is then brought to switch setting 502, in which the electromagnet 503 of spinning position 107 pivots its angle lever 505. Simultaneously, the relay 462 is excited and is kept excited via its auto-hold contact 465, and via contact 463 switches the travel motor 46 to travel to the left, until switch 509 is opened after reset guide 32 runs onto the positioning pin 508, upon which the current flow through relay 462 and the travel motor 46 is interrupted and the servicing apparatus is halted.

If for any reason the servicing apparatus 3 is to be halted before reaching the pivoted angle lever 505, this can occur from the spinning position to be serviced by actuation of switch 94.

According to the spacing of the spinning positions from each other, it can be sufficient if the switches 500 and/or 94 are not provided at each spinning position, but for a respective switch 500 and/or 94 to be associated with two or three spinning positions. In each case it is necessary to take care that the operator can reach the switch 500 forming the call device from each spinning position without leaving it, while the servicing apparatus 3 is halted within reach of the operator 6, but outside the space required for servicing of the spinning position.

Instead of a switch having a middle setting and two end settings, a separate switch can also be provided for each direction.

The switch-off device consisting of the reset guide 32, angle lever 55 (sic) and switch 509 can have various designs. Thus the reset guide 32 and, correspondingly, also the angle lever 505, can be arranged at various positions of the servicing apparatus 3. For example, the reset guide 32 is on the lower or upper side, or even on the side remote from the open-end spinning machine, of the servicing apparatus 3. Instead of mechanically, the reset guide can also operate without contact, e.g., magnetically. Correspondingly, it is also not necessary for an angle lever 505 to be utilized, but another suitable element can be utilized instead.

What is claimed is:

1. A method for servicing a number of mutually adjacent spinning positions of an open-end spinning machine by means of a servicing apparatus which is movable along said spinning positions, each of said spinning stations having a bobbin carried thereon upon which yarn is being wound, said method comprising the following steps:

an operator while preparing to service a spinning position that is to be serviced triggering a circuit for initiating the movement of said service apparatus from its existing location to adjacent said spinning position to be serviced;

maintaining said service apparatus adjacent said spinning position until said operator concludes the preparatory work;

bringing said service apparatus from said position adjacent said spinning position into the exact working position for the initiation and carrying out of the servicing; and setting said service apparatus into operation.

2. The method as set forth in claim 1 wherein said triggering a circuit for initiating the movement of said service device comprises:

the lifting of said bobbin during said preparatory work by said operator causes the triggering of said circuit.

3. An apparatus for servicing a number of mutually adjacent spinning positions of an open-end spinning machine by means of a servicing apparatus which can move along said spinning positions, said apparatus comprising:

a travel drive means (40) for said servicing apparatus (3) for driving said servicing apparatus along said spinning machine when activated;

switch means (5, 56, 560) connected to said travel drive means (40) for activating said travel drive means responsive to being actuated by an operator at a spinning station requiring serive, and switch means connected to said travel drive means (40) for de-activating said travel drive means for halting the movement of said servicing apparatus in the neighborhood of said operator at said spinning station requiring service.

4. The apparatus as set forth in claim 3 further comprising a holding device (464, 465) shunting said switch means (5, 56, 560) which activates said travel drive means.

5. The apparatus as set forth in claim 4 further comprising:

a switch device provided at each spinning position for interrupting said holding device (464,465).

6. Servicing apparatus according to claim 3 or 4, characterized in that a separate connection switch means (56, 560) is provided for each direction of travel.

7. Servicing apparatus according to claim 6, characterized in that each connection switch means (56, 560) has a light beam (5) arranged between one end (11, 12) of the open-end spinning machine (1) and the servicing apparatus (3), and can be broken by the operator when servicing a spinning position.

8. Servicing apparatus according to claim 7, characterized in that the light beam (5) has a light source and a photocell, which are arranged stationary at the end (11, 12) of the open-end spinning machine (1), and also a reflector (52) which can travel with the servicing apparatus.

9. Servicing apparatus according to claim 3 further comprising said connection switch means (5, 56, 560) can be rendered inoperative.

10. Servicing apparatus according to claim 3 further comprising:

a coupling (48) which can be actuated simultaneously with the travel drive means (40) and which effects a mechanical drive connection between the open-end spinning machine (1) and said servicing apparatus (3).

11. Servicing apparatus according to claim 3 further comprising:

a separate disconnection switch means (530, 731) is provided for each direction of travel.

12. Servicing apparatus according to claim 11 further comprising:

said disconnection switch means (53, 530, 531) is arranged on the servicing apparatus (3) such that, in the direction of travel of said servicing apparatus (3), it senses the space corresponding to the reach of the operator (6).

13. Servicing apparatus according to claim 11 further comprising:

said disconnection switch means (53) is an infrared switch.

14. Servicing apparatus according to claim 4 further comprising:

said servicing apparatus (3) has, for each direction of travel, a limit switch (9, 90) connected in controlling relation with said travel drive means (40), with a respective associated stop (91, 92) at the end (11, 12) of the open-end spinning machine (1).

15. Servicing apparatus according to claim 14 further comprising:

a further disconnection switch device (93) fitted to the servicing apparatus (3) and for actuation by the operator, is associated with said travel drive means (40).

16. Servicing apparatus according to claim 15 further comprising:

said disconnection switch means (53, 530, 531) which interrupts the travel drive means (40) simultaneously forms the connection switch device for a working drive (7) which can be set in operation by the operator.

17. Servicing apparatus according to claim 16, further comprising:

with the working drive (7) there is associated a holding device (730) which shunts its disconnection means (53, 530, 531).

18. Servicing apparatus according to claim 17 further comprising:

a safety device (700) which interrupts the travel drive means (40) during the period in which the working drive (7) is switched on.

19. Servicing apparatus according to claim 18 further comprising:

a switch drive (74) which can be actuated by the operator and which switches on said working drive (7).

20. Servicing apparatus according to claim 19 further comprising:

a timing unit (73) which can be switched on with the switching on of said working drive (7) and independently of this on initiation of the servicing work, and by which the working drive (7) can be interrupted after expiry of the allotted time.

* * * * *